US005488849A

United States Patent [19]

Röpke

[11] Patent Number: 5,488,849

[45] Date of Patent: Feb. 6, 1996

[54] ROLLING AND FLANGING TOOL TO BEND BACK AND/OR WIDEN FENDER-WHEEL WELL EDGES

[75] Inventor: Thomas Röpke, Springe, Germany

[73] Assignee: Thomas Röpke Werkzeugbau und Technischer Vertrieb, Springe, Germany

[21] Appl. No.: 206,172

[22] Filed: Mar. 7, 1994

[51] Int. Cl.[6] ..... B21D 19/00; B21D 53/88

[52] U.S. Cl. ..... 72/210; 72/211; 72/705

[58] Field of Search ..... 72/210, 211, 215, 72/248, 705; 29/401.1

[56] References Cited

U.S. PATENT DOCUMENTS

| | | | |
|---|---|---|---|
| 1,739,488 | 12/1929 | Thayer | 72/705 |
| 1,775,968 | 9/1930 | Nelson | 72/705 |
| 1,813,012 | 7/1931 | Asher | 72/215 |
| 1,826,834 | 10/1931 | Shaw | 72/248 |
| 1,880,246 | 10/1932 | Greiner | 72/211 |
| 1,893,196 | 1/1933 | Buck | 72/248 |
| 2,274,032 | 2/1942 | Blair | 72/705 |
| 2,664,063 | 12/1953 | Makruski | 72/705 |

FOREIGN PATENT DOCUMENTS

| | | | |
|---|---|---|---|
| 199024 | 8/1988 | Japan | 72/160 |
| 893304 | 12/1981 | U.S.S.R. | 72/160 |

*Primary Examiner*—Daniel C. Crane

*Attorney, Agent, or Firm*—Shlesinger Arkwright & Garvey

[57] ABSTRACT

The invention concerns a rolling and flanging tool to bend back and/or widen fender-wheelwell edges of motor vehicles. To carry out the bending back and/or widening of fender-wheelwell edges in simpler and more uniform manner and without risk of damage to the enamel and sheet-metal, a flanging roll 46 to be pressed against the fenders is provided, which is connected to an affixing flange 4 to be affixed to the motor-vehicle axle, said roll being pivotable about said axle.

19 Claims, 2 Drawing Sheets

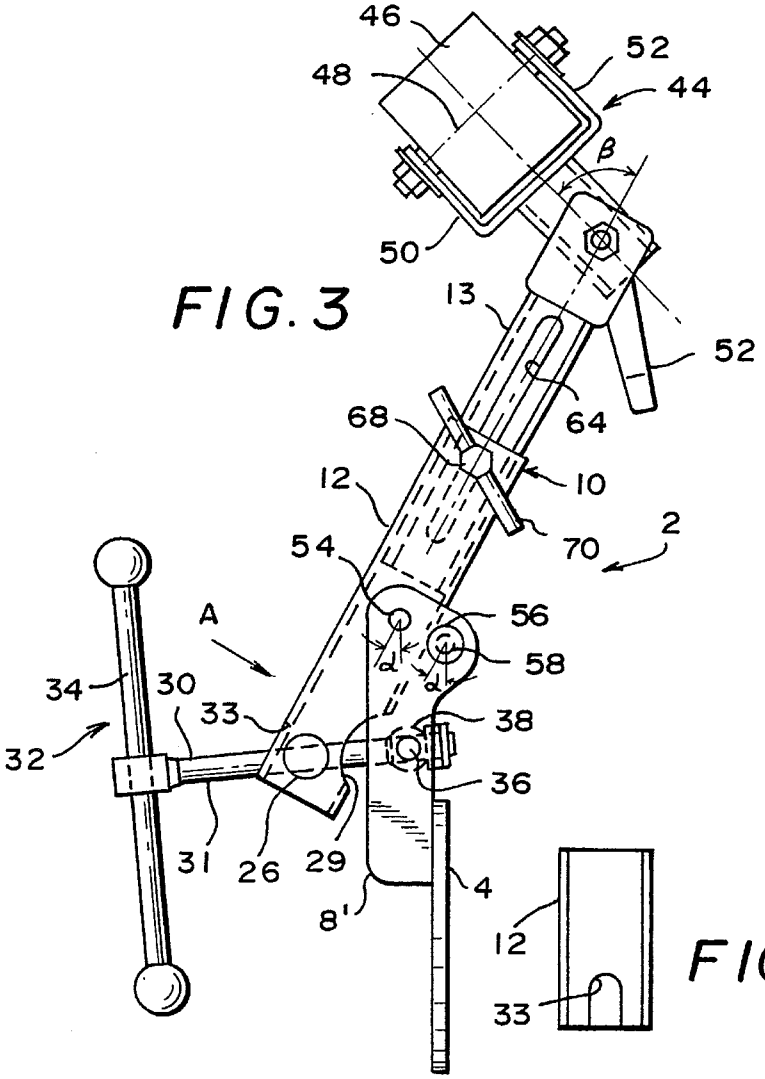
FIG. 3
FIG. 5
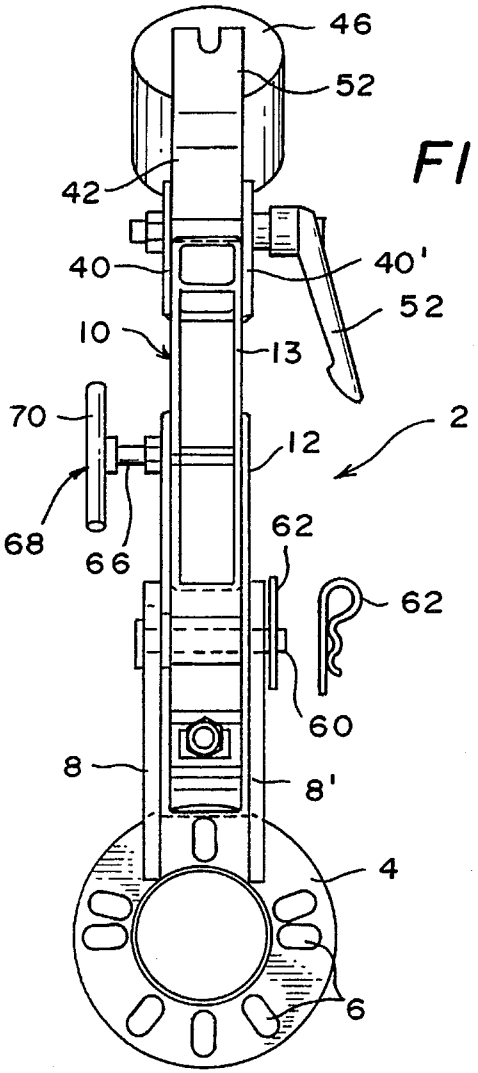
FIG. 4

ROLLING AND FLANGING TOOL TO BEND BACK AND/OR WIDEN FENDER-WHEEL WELL EDGES

BACKGROUND OF THE INVENTION

The invention concerns a rolling and flanging tool.

To install wide tires and the corresponding wheel rims, the fender-wheelwell edges must be bent back and/or widened. The tool used heretofore (FACHKENTNISSE KAROSSERIE- UND FAHRZEUGBAU, Handwerk und Technik publishers, Hamburg, 1985, pp 35–6) using a flanging hammer or flanging tongs entailed tearing and damaging the enamel even when heating the fender and repainting was therefore required. The sheetmetal itself is dented in the process and loses rigidity. Furthermore the fender-work is fairly time-consuming and requires skilled labor.

The object of the present invention is to create a rolling and flanging tool of the initial cited kind allowing to bend back and/or widen fender-wheelwell edges in simpler and more uniform manner without the risk of damaging the enamel and sheetmetal of the fender-wheelwell edge.

This problem is solved by the design of the present invention.

The rolling and flanging tool of the invention allows simpler and more uniform rolling and/or flanging of fender-wheelwell edges. The tool is applicable to all kinds of motor vehicles. The pressure applied by the flanging roller used is adjustable and the roller merely needs being pivoted to bend back and/or widen fender wheelwell-edges which in known manner are previously heated. It was discovered in surprising manner that cracks in and damage to the enamel no longer arise when using the tool of the invention and consequently the repainting previously required is eliminated. The tool of the invention is handled in the simplest possible manner and also can be used by semi-skilled labor. The danger of denting the sheetmetal and of loss of rigidity is eliminated.

Advantageous and appropriate further developments of the solutions of the invention are stated in the detailed description of the preferred embodiment.

BRIEF DESCRIPTION OF THE DRAWINGS

The invention is elucidated below in relation to the attached drawing.

FIG. 3 is a sideview of a second embodiment mode of a rolling and flanging tool, FIG. 4 is a topview of the tool of FIG. 3, and FIG. 5 is an elevation A of the tool of FIG. 3.

DETAILED DESCRIPTION OF THE PREFERRED EMBODIMENT

Figures 1, 2:
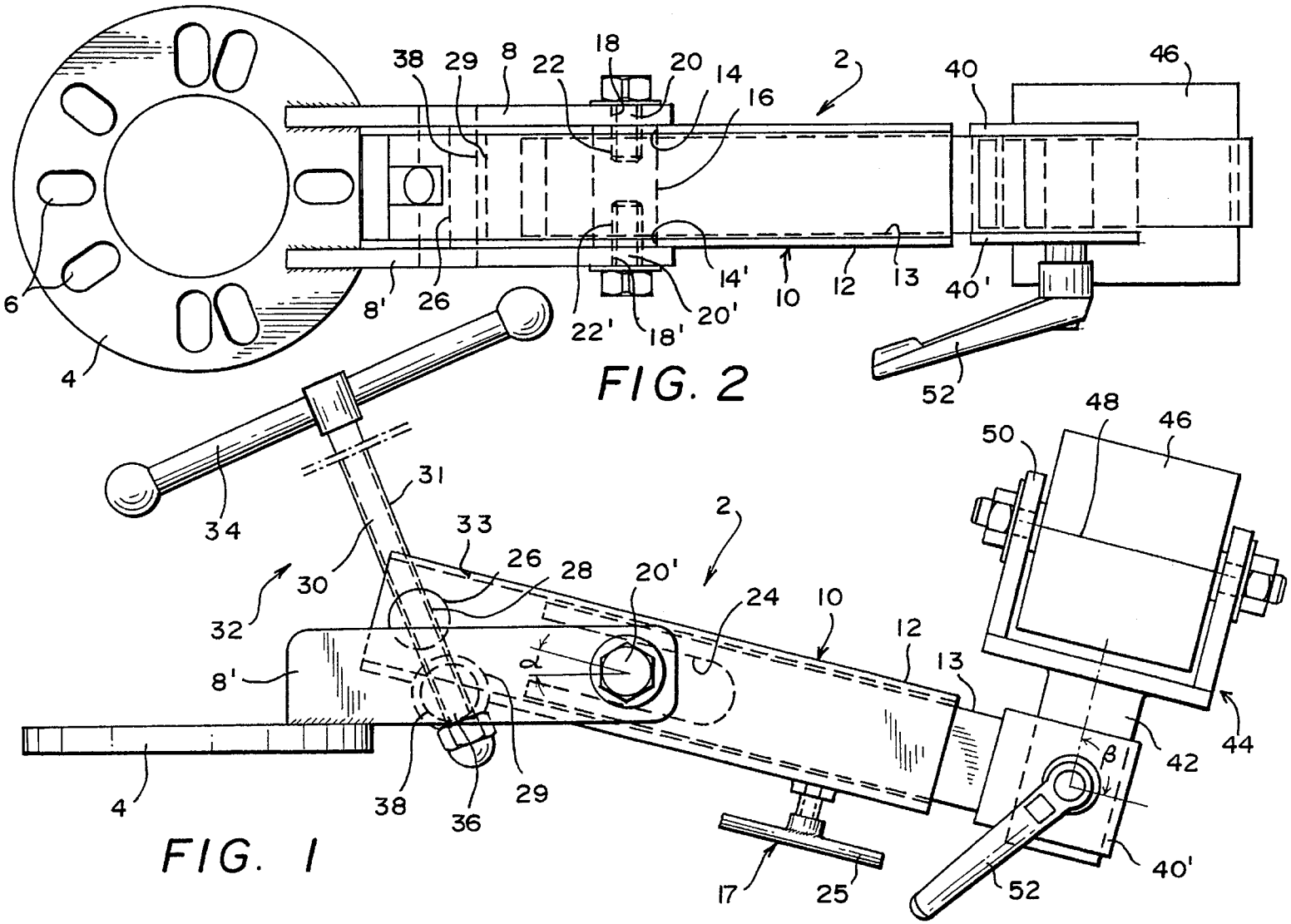
FIG. 1 is a sideview of a first embodiment mode of a rolling and flanging tool.
FIG. 2 is a topview of the tool of FIG. 1.

In the Figures of the drawing, the same components are denoted by the same references.

The drawing shows a tool 2 to roll and flange the wheelwell-edges of motor-vehicle fenders.

The tool 2 comprises an annular affixing flange 4 with a UNIVERSAL array 6 of elongated slots for fastening to the axle of a motor vehicle after its wheel has been removed. Two rectangular, parallel planar legs 8, 8' welded to the affixing flange 4 project from it and receive between them a pivotable, telescoping system of rectangular tubes 10.

The telescoping rectangular-tube system 10 comprises an outer rectangular-tube 12 receiving a displaceable inner rectangular tube 13.

In its end facing the affixing flange 4, the outer tube 12 receives a rotatably supported shaft 26 which is centrally traversed by a radial threaded borehole 28 receiving a threaded segment 31 of a threaded spindle 30 of a pulling device 32 with grip 34.

One end zone 36 of the threaded spindle 30 is mounted in freely rotatable manner in a shaft 38 rotatably mounted between the two legs 8, 8' of the affixing flange 4. The outer tube 12 of the telescoping rectangular-tube system 10 comprises at its underside an arcuate clearance 29 into which can be pivoted the shaft 38 of the legs 8, 8'. At its top side, the outer tube comprises a clearance 33 at its side near the flange (FIG. 5) into which can be pivoted the threaded spindle 30.

The angle $\alpha$ between the telescoping rectangular-tube system 10 and the legs 8, 8', ie the affixing flange 4, can be adjusted by rotating the threaded spindle 30.

At its end projecting out of the outer tube 12, the inner tube 13 of the telescoping rectangular-tube system 10 comprises two planar supports in the form of clamping jaws 40, 40' supporting between them the stem 42 of a forked bearing 44 for a plastic flanging roll 46 of which the shaft 48 rests in rotatable manner in the U-legs 50, 50' of the bearing 44. Using a tightening lever 52, the angle $\beta$ between the flanging roll 46 and the telescoping rectangular-tube system 10 can be matched to the angle of the fender-wheelwell edge.

In the embodiment mode of FIGS. 1 and 2, the outer tube comprises a borehole 14, 14' located approximately centrally in each of the shorter sides of the rectangle and receiving a shaft 16. The free ends of the legs 8, 8' each comprise a borehole 18, 18' aligned with the boreholes 14, 14' and passing screws 20, 20' entering axially threaded boreholes 22, 22' of the shaft 16.

At its end located in the outer tube 12, the inner tube 13 comprises two laterally open slots 24 traversed by the shaft 16. The inner tube 13 is affixable by a tightening screw 17 fitted with a grip 25 into the outer tube 12.

In the embodiment mode of FIGS. 3 through 5, the outer rectangular tube 12 comprises a borehole 54 in the two small rectangle sides and a bearing 56 welded onto its underside, said bearing 56 comprising a borehole 58 which is parallel to the borehole 54. The assembly of the rectangular outer tube 12 takes place depending on the required range of adjustment in the borehole 54 or in the borehole 58 by means of a bolt 60 secured by a W-clip 62 (FIG. 4). The assembly into the borehole 54 corresponds to the design of FIGS. 1 and 2.

The inner tube 13 comprises a lateral elongated slot 64 through which the threaded shank 66 of a tightening screw 68 fitted with a grip 70 and mounted on an inside-threaded part 72 welded onto the outer tube 12 can be turned to come to rest against the opposite rectangular side of the inner tube 13 in order to clamp the inner tube into the outer tube.

The tool is operated as follows: Once the affixing flange 4 has been mounted to the axle, the inner tube 13 is moved in or out to such an extent that the flanging roller 46 is moved into the vicinity of the fender-wheelwell edge. Thereupon the slope of the flanging roller (angle $\beta$) is matched to the angle of the fender-wheelwell edge. By rotating the threaded spindle 30 and tightening the telescoping rectangular-tube system 10, the angle $\alpha$ between the telescoping rectangular-tube system 10 and the legs 8, 8' is reduced to generate compression by the flanging roll on the fender-wheelwell edge. By pivoting the tool together with the motor-vehicle axle, the previously heated fender-wheelwell edge then is bent back and/or widened, said heating for instance being by a hot-air gun.

The embodiment mode of FIGS. 3–5 offers the following advantages relative to that of FIGS. 1 and 2: The range of adjustment of the tool is enlarged by the two boreholes 54, 58 and the elongated slot 64. When the set-up of the borehole 58 is used, the limitations set by the bolt 60 on the adjusting range of the telescoping tube system is eliminated. The tool is sturdier because the closed rectangular or box cross-sections are being used and the slots 24 of the embodiment mode of FIGS. 1 and 2 can be eliminated.

I claim:

1. A rolling and flanging tool for uniformly reforming a fender wheelwell comprising:

a) an elongated body member having a working end and a securing end;

b) an affixing flange extending from said securing end, said affixing flange configured to secure said first end of said tool to a vehicle axle for rotation therewith;

c) a flanging roller extending from said working end, said flanging roller adapted to roll against a fender wheelwell and along an arcuate path as the vehicle axle is rotated; and d) adjustable fixing member, said fixing member configured to variably fix the position of said flanging roller relative to the vehicle axle and simultaneously compress said flanging roller against the fender wheelwell whereby rotation of the vehicle axle will roll said flanging roller against the fender wheelwell along a uniform arc and reform the same.

2. A rolling and flanging tool as in claim 1 and wherein:

a) said elongated body member is an adjustable length telescopic tube;

b) said telescopic tube including an exterior tube and an interior tube slidably received therein; and c) said interior tube includes said body member working end and said exterior tube includes said body member securing end.

3. A rolling and flanging tool as in claim 1 and wherein:

a) said adjustable fixing member including pivot members for securing each of said flanging roller and said affixing flange to said body member.

4. A rolling and flanging tool as in claim 2 and wherein:

a) said affixing flange including a pair of parallel leg members extending therefrom and having at least a portion of said telescopic tube positioned therebetween, said affixing flange is pivotally mounted to said telescopic tube about said leg members.

5. A rolling and flanging tool as in claim 4 and wherein:

a) said adjustable fixing member including a borehole extending through said securing end of said telescopic tube and transverse thereto and a rotatable spindle member operational therewith, said spindle member threadedly received within said borehole and having one end thereof rotatably secured to said affixing flange leg members and extending therebetween whereby rotation of said spindle will selectively pivot said elongated body member relative to said affixing flange.

6. A rolling and flanging tool as in claim 4 and further comprising:

a) bolt members for pivotally mounting each of said leg members to said elongated body member; and b) said interior tube including a pair of longitudinal slots extending therein, each of said slots adapted to receive a respective one of said bolt members as the length of said telescopic tube is adjusted.

7. A rolling and flanging tool as in claim 4 and further comprising:

a) means for variably mounting said leg members to said telescopic tube.

8. A rolling and flanging tool as in claim 7 and wherein:

a) said variable mounting means including at least two pairs of boreholes extending through said leg members, each of said at least two pairs of boreholes is adapted for pivotal mounting with one of at least two cooperating passageways associated with said exterior tube.

9. A rolling and flanging tool as in claim 8 and wherein:

a) each of said at least two cooperating passageways is a shaft member extending between and interconnecting said leg members.

10. A rolling and flanging tool as in claim 9 and wherein:

a) one of said at least two cooperating passageways includes a bearing member, said one of said at least two cooperating passageways is affixed to the exterior surface of said exterior tube; and b) the other of said at least two cooperating passageways passes through said elongated tube.

11. A rolling and flanging tool as in claim 1 and wherein:

a) said adjustable fixing member including a clamping member extending from said body member working end for adjustably securing said flanging roller to said body member at a desired angle therebetween.

12. A rolling and flanging tool as in claim 11 and wherein:

a) said flanging roller including a flanging roll rotatably mounted within a roller support frame member; and b) said roller support frame member including a stem portion extending transverse to the rotational axis of said flanging roll, said stem portion is secured within said clamping member.

13. A rolling and flanging tool as in claim 5 and further including:

a) a spindle shaft member for rotatably securing said spindle member end to said leg members; and b) said elongated body member including a spindle shaft recess member to enable free movement of said spindle shaft member during rotation.

14. A rolling and flanging tool as in claim 2 and further comprising:

a) locking member operatively associated with said exterior tube and said interior tube, said locking member configured to adjustably secure said exterior tube to said interior tube.

15. A rolling and flanging tool as in claim 14 and wherein:

a) said locking member including a slot member extending along the longitudinal axis of said interior tube, said slot member configured to receive a locking screw member extending through said exterior tube.

16. A rolling and flanging tool for uniformly reforming a fender wheelwell comprising:

a) an elongated body member having a working end and a securing end, said elongated body member including a length adjustable telescopic tube comprising an exterior tube and an interior tube slidably received therein, said interior tube includes said working end and said exterior tube includes said securing end;

b) an affixing flange extending from said securing end, said affixing flange adapted to secure said first end of said tool to a vehicle axle for rotation therewith;

c) a flanging roller extending from said working end, said flanging roller positionable against a fender wheelwell for reforming the same;

d) an adjustable clamping member extending from said body member working end for adjustably securing said flanging roller to said body member at a desired angle therebetween; and e) means for variably fixing said flanging roller relative to the vehicle axle and simultaneously compressing said flanging roller against the fender to be reformed whereby rotation of the vehicle axle will roll said flanging roller along the vehicle fender in a continuous and uniform arc and reform the same.

17. A rolling and flanging tool as in claim 16 and wherein:

a) said flanging roller including a flanging roll rotatably mounted within a support frame member; and b) said support frame member including a stem portion extending transverse to the rotational axis of said flanging roll, said stem portion is secured within said adjustable clamping member.

18. A rolling and flanging tool as in claim 16 and wherein:

a) said affixing flange including a pair of parallel leg members extending therefrom and having at least a portion of said elongated body member extending therebetween, said affixing flange is pivotally mounted to said elongated body member about said leg members.

19. A rolling and flanging tool as in claim 18 and wherein:

a) said variably fixing means including a borehole extending through said elongated body member securing end and transverse thereto a rotatable spindle member operational therewith, said spindle member threadedly received within said borehole and having one end thereof rotatably secured to said affixing flange leg members and extending therebetween whereby rotation of said spindle will selectively pivot said elongated body member relative to said affixing flange.

* * * * *